US005457283A

United States Patent [19]

Yu et al.

[11] Patent Number: 5,457,283

[45] Date of Patent: Oct. 10, 1995

[54] APPARATUS FOR COATING AND DRYING PAPER SHEETS

[75] Inventors: Tom Y. Yu, 8364 Reservoir Rd., Fulton, Md. 20759; Randy L. Hendrickson, Seaford, Del.

[73] Assignee: Tom Y. Yu, Fulton, Md.

[21] Appl. No.: 285,209

[22] Filed: Aug. 3, 1994

Related U.S. Application Data

[63] Continuation of Ser. No. 209,886, Mar. 14, 1994, abandoned, which is a continuation of Ser. No. 33,350, Mar. 18, 1993, abandoned.

[30] Foreign Application Priority Data

Nov. 19, 1992 [CN] China ..... 92241262.6

[51] Int. Cl.[6] ..... B05C 1/12

[52] U.S. Cl. ..... 118/62; 118/231; 34/619; 34/621; 34/629; 34/639

[58] Field of Search ..... 118/58, 62, 231; 226/97; 34/155, 156, 619, 621, 629, 639, 659

[56] References Cited

U.S. PATENT DOCUMENTS 1,701,878 2/1929 Freegard .

3,530,823 9/1970 Giordano ..... 118/231

*Primary Examiner*—David A. Simmons

*Assistant Examiner*—John Hoffmann

*Attorney, Agent, or Firm*—Donald A. Kettlestrings

[57] ABSTRACT

A space-saving apparatus and method for coating paper sheets with lacquer and drying the sheets with streams of air are provided. The sheets are coated with lacquer and are moved by parallel and spaced apart conveyer belts in a first direction as the sheets are dried and supported by streams of air that are directed against the paper sheets and against and through the undersides of the conveyer belts. The movement of the paper sheets is then reversed to a second direction and the dried sheets are collected above the conveyer belts as they move in the second direction.

7 Claims, 3 Drawing Sheets

APPARATUS FOR COATING AND DRYING PAPER SHEETS

CROSS-REFERENCES TO RELATED APPLICATIONS

This application is a continuation of application Ser. No. 08/209,886, filed Mar. 14, 1994, for Paper Sheet Coating Apparatus With Gas Streams Drying And Auxiliary Transporting System, now abandoned, which was a continuation of application Ser. No. 08/033,350, filed Mar. 18, 1993, for Paper Sheet Coating Apparatus With Gas Streams Drying And Auxiliary Transporting System, now abandoned.

BACKGROUND OF THE INVENTION

This invention relates to a paper sheet coating apparatus with gas stream drying and auxiliary transporting system. The term "sheet" used hereafter indicates paper sheet, particularly photographic paper sheet.

DESCRIPTION OF THE PRIOR ART

The coating apparatus commonly used is described with reference to the accompanying drawing FIG. 1. Sheets pass through coating means which comprises a driving roller 2, a lacquering roller 1 and a pushing roller 3, then they are carried by a conveyer 9 forward to a sheets collector 11. An electric heat-drying means 10 is set above the conveyer 9. A scraper 4 presses the pushing roller 3 to clean it. The lacquer squeezed passes through a lacquer collector 5 and flows toward lacquer container 6. A pump 7 and lacquer pipe 8 lead lacquer up to lacquering roller 1. The overcharged lacquer passes through upper lacquer collector 12 and lacquer leading pipe 13, then flows into lacquer collector 5. This apparatus needs large space, because there should be enough area in said heat-drying means to secure thermal uniformity during heat-drying processing, and at the end of the conveyer 9, a sheets collector 11 occupied another range lengthwise. But under the conveyer 9 a considerable area is not used.

SUMMARY OF THE INVENTION

The object of this invention is to provide a sheet coating apparatus with a gas streams drying and auxiliary transporting system. It is constructed compactly and effectively.

The object has been attained by the paper sheet coating apparatus with gas streams drying and auxiliary transporting system according to this invention, which comprises: coating means whose sheet exit is in accord with lower side of a sheets conveyer;

said sheets conveyer having conveyer belts which are permeable to gas streams;

means for supplying and directing gas streams which blow crosswise onto the coated side of sheets or pass through said conveyer belts, spaced under said sheets conveyer;

sheets reversing means embracing the end of said sheets conveyor; and a sheets collector mounted above said sheets conveyer, performing the functions of covering the machine and collecting the dried sheets.

Sheets pass through a coating means and are lacquered only on one side. The wet coated sheets are then pushed toward the sheets conveyer in which the coated side of each of the sheets faces a means for supplying and directing gas streams. The bare side of each of the sheets is pressed against conveyer belts of the sheets conveyer by the gas streams. The gas streams blow crosswise onto the wet coated sheets and dry them during the travel. A sheets reversing means is capable of guiding the sheets between the sheets reversing means and the sheets conveyer to reverse the direction of travel of the sheets back toward the sheet entering direction. The sheets reversing means also pushes the sheets out and off from the sheets conveyer. The coated and dried sheets depart from the conveyer and fall on the sheets collector which performs the functions of covering the machine and collecting the dried sheets.

The advantage of this invention is the creative compacting of the length of the conveyer, saving the space for the sheets collector and efficient use of the space in and out of the apparatus.

BRIEF DESCRIPTION OF THE DRAWINGS

The invention will be better understood by reference to the accompanying drawings.

DESCRIPTION OF THE PREFERRED EMBODIMENT

Figure 1:
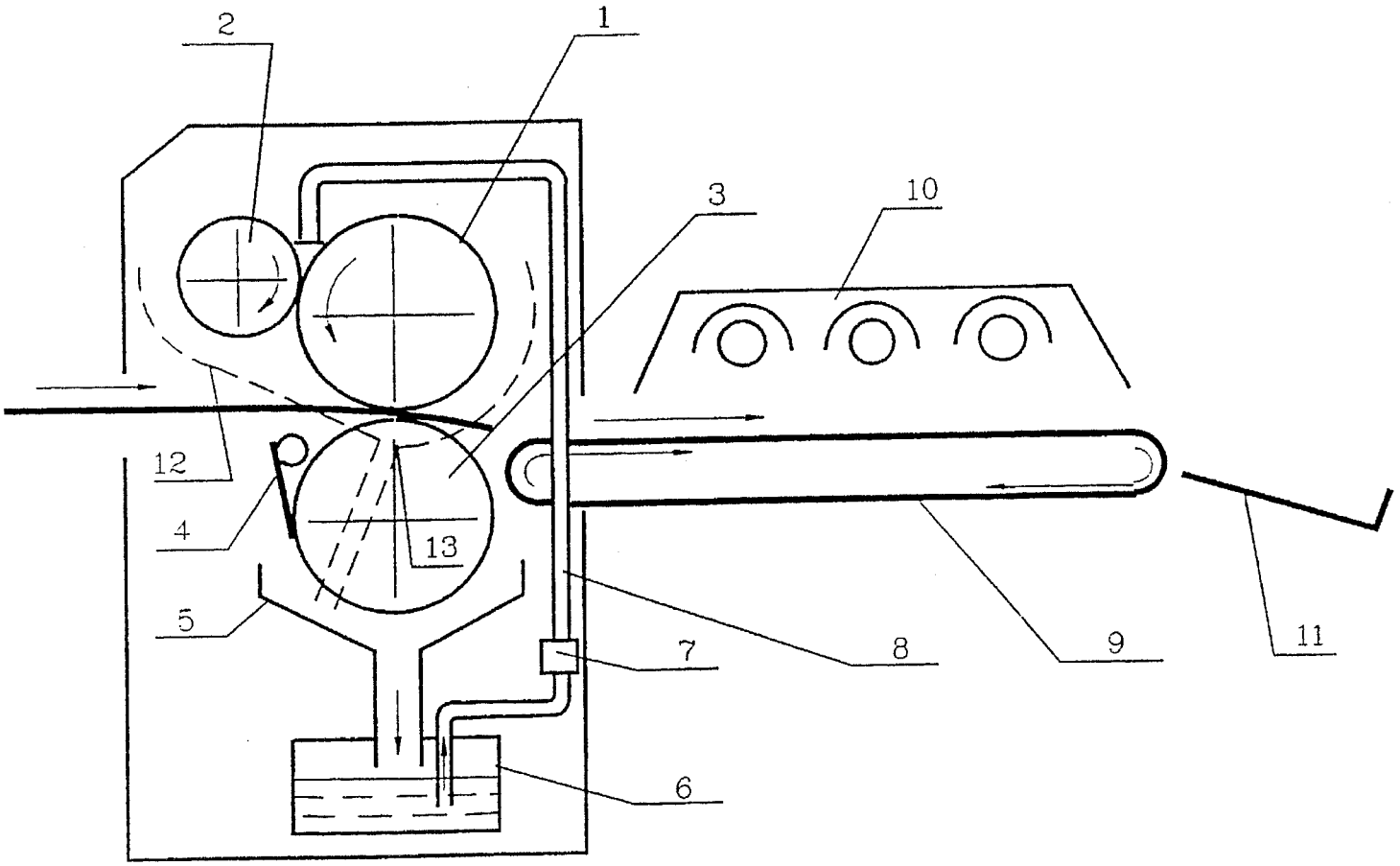
Fig. 1 PRIOR ART
FIG. 1 is an elevation view of a prior art apparatus for coating paper sheets.
Figure 2:
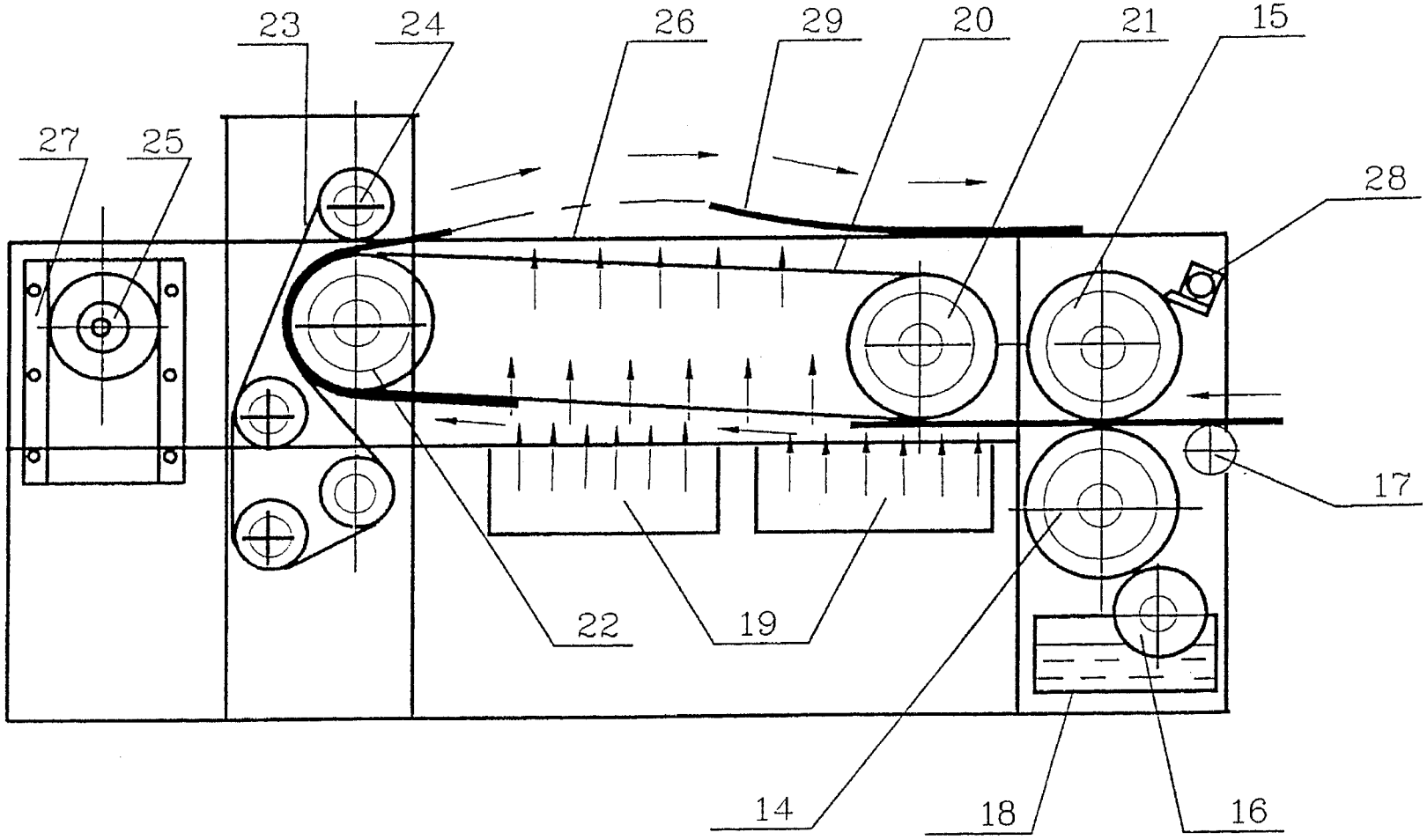
FIG. 2 is a diagrammatic elevation view of the apparatus of this invention.
Figure 3:
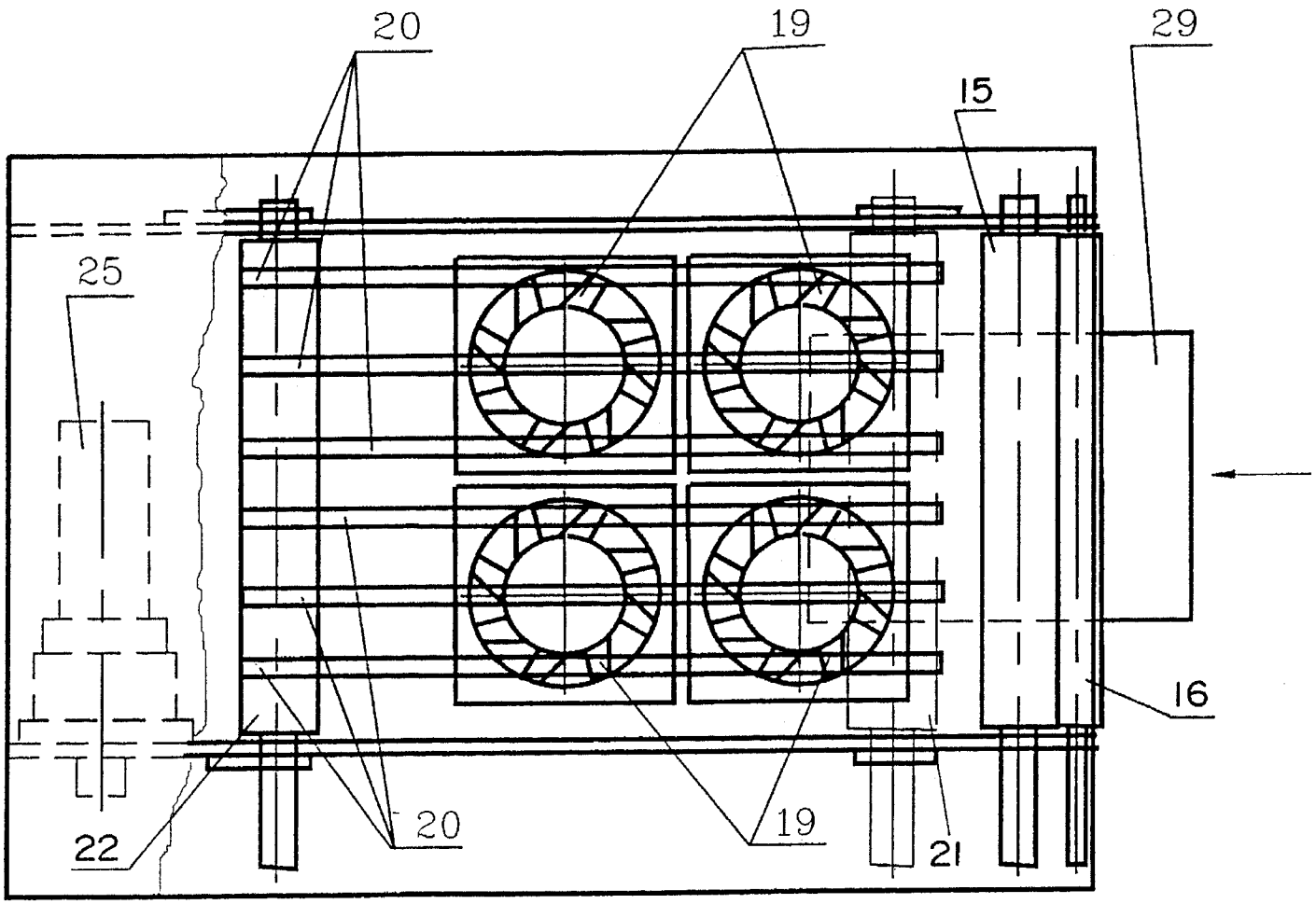
FIG. 3 is a fragmentary plan view of the apparatus of this invention.

FIGS. 2 and 3 are an elevation view and a plan view of the paper sheets coating apparatus with air streams drying and auxiliary transporting system. This apparatus has: apparatus stand 27; driving motor 25; coating means which comprises lacquer tray 18, first lacquer roller 16, second coating roller 14, third pressure roller 15, fourth supporting roller 17, squeegee 28 pressed on pressure roller 15; the lacquer roller 16, coating roller 14 and pressure roller 15 contact each other parallelly; sheets conveyer which comprises fifth driving wheel or roller 22, sixth idler wheel or roller 21 at a first predetermined location, a plurality of first rubber conveyer belts 20 spaced apart parallelly and therefor being permeable to air streams.

The sheet exit of the coating means is in accord with the lower side of the sheets conveyer; fans 19, as means for supplying and directing air streams, are spaced under the sheets conveyer; sheets reversing means embrace the end of the sheets conveyer, and the sheets reversing means comprise a reversing wheel or roller system generally designated as 24 with second rubber belt 23; and sheets collector 26 mounted above the sheets conveyer. The sheets collector 26 performs the functions of covering the machine and collecting dried sheets 29.

Lacquer roller 16 is immersed partially in lacquer tray 18 and carries lacquer to coating roller 14. Sheets 29 are pushed forward between coating roller 14 and pressure roller 15 for lacquering. A squeegee 28, pressed on pressure roller 15, scrapes the lacquer on the pressure roller 15. After the lacquering processing, the wet coated paper sheets are forced to the paper sheets conveyer and their coated side faces the air streams. The air streams generated by fans 19 blow crosswise onto the sheets and press the sheets against conveyer belts 20. As a result, the sheets are dried by air streams during their travel. The dried paper sheet between rubber belt 23 of the sheets reversing or redirecting means 24 and rubber conveyer belts 20 of the sheets conveyer is redirected or reversed back toward the sheet entering direction and is pushed out and off onto the sheets collector 26, which performs the functions of covering the machine and collecting the sheets.

What is claimed is:

1. Paper sheet coating and drying apparatus, comprising:

means for receiving said paper sheet and coating said paper sheet with lacquer and for moving said paper sheet to a first location, said receiving and coating means including a tray for containing said lacquer, a first roller defining a first axis, said first roller positioned in operative relationship with said tray for depositing said lacquer onto said first roller as said first roller rotates about said first axis, a second roller defining a second axis, said second roller positioned to receive said lacquer from said first roller as said first and second rollers rotate about said first and second axes, respectively, and a third roller defining a third axis, said third roller positioned in operative relationship with said second roller for receiving said paper sheet therebetween;

sheet conveyer means including a plurality of first spaced apart, gas stream permeable, conveyer belts positioned at said first location for receiving said paper sheet from said coating and moving means and for conveying said paper sheet in a first direction;

means in operative relationship with said conveyer means for supplying and directing gas streams against said paper sheet and through said spaced apart conveyer belts for pressing and holding said paper sheet against said conveyer belts and for drying said paper sheet;

means in operative relationship with said sheet conveyer means for redirecting movement of said paper sheet to a second direction substantially opposite to said first direction;

a paper sheet collector positioned in operative relationship with said sheet conveyer means and with said redirecting means for receiving and collecting said paper sheet as said paper sheet moves in said second direction;

wherein said means for receiving and coating said paper sheet and for moving said paper sheet further includes a fourth roller defining a fourth axis, said fourth roller positioned for supporting said paper sheet before it passes between said second and third rollers, and a squeegee in operative relationship with said third roller for squeegeeing said lacquer on said third roller.

2. Apparatus as in claim 1 wherein said paper sheet collector is mounted above said sheet conveyer means.

3. Apparatus as in claim 2 wherein said sheet conveyer means includes:

a first, driving wheel defining a fifth axis;

a motor in operative relationship for turning said driving wheel about said fifth axis;

a second, idler wheel; and said first conveyer belts connected between said driving wheel and said idler wheel.

4. Paper sheet coating and drying apparatus, comprising:

means for receiving said paper sheet and coating said paper sheet with lacquer and for moving said paper sheet to a first location;

sheet conveyer means including a plurality of first spaced apart, gas stream permeable, conveyer belts positioned at said first location for receiving said paper sheet from said coating and moving means and for conveying said paper sheet in a first direction;

means in operative relationship with said conveyer means for supplying and directing gas streams against said paper sheet and through said spaced apart conveyer belts for pressing and holding said paper sheet against said conveyer belts and for drying said paper sheet as said paper sheet moves in said first direction;

means in operative relationship with said sheet conveyer means for redirecting movement of said paper sheet to a second direction substantially opposite to said first direction; and a paper sheet collector mounted above said sheet conveyer means and positioned in operative relationship with said sheet conveyer means and with said redirecting means for receiving and collecting said paper sheet as said paper sheet moves in said second direction.

5. Apparatus as in claim 4 wherein said paper sheet collector is mounted directly above said sheet conveyer means.

6. Apparatus as in claim 5 wherein said gas streams supplying and directing means are under said sheet conveyer means.

7. Apparatus as in claim 6 wherein said gas streams supplying and directing means are directly under said sheet conveyer means.

* * * * *